US010104966B2

(12) United States Patent
Lawson

(10) Patent No.: US 10,104,966 B2
(45) Date of Patent: Oct. 23, 2018

(54) GLIDER RECLINE LINKAGE WITH DOUBLE BLOCKER CAMS

(71) Applicant: L&P PROPERTY MANAGEMENT COMPANY, South Gate, CA (US)

(72) Inventor: Gregory Mark Lawson, Tupelo, MS (US)

(73) Assignee: L&P Property Management Company, South Gate, CA (US)

( * ) Notice: Subject to any disclaimer, the term of this patent is extended or adjusted under 35 U.S.C. 154(b) by 86 days.

(21) Appl. No.: 15/485,711

(22) Filed: Apr. 12, 2017

(65) Prior Publication Data

US 2018/0027965 A1 Feb. 1, 2018

Related U.S. Application Data

(60) Provisional application No. 62/368,283, filed on Jul. 29, 2016.

(51) Int. Cl.
*A47C 1/034* (2006.01)
*A47C 3/025* (2006.01)

(52) U.S. Cl.
CPC ..... *A47C 1/0342* (2013.01); *A47C 1/0345* (2013.01); *A47C 3/0255* (2013.01)

(58) Field of Classification Search
CPC ... A47C 1/0342; A47C 1/0345; A47C 1/0347; A47C 1/031; A47C 1/032; A47C 1/034; A47C 3/0255
USPC ..... 297/84, 83, 85 M, 88, 89, 90, 91, 75, 297/259.2, 259.3
See application file for complete search history.

(56) References Cited

U.S. PATENT DOCUMENTS 4,071,275 A 1/1978 Rogers, Jr.
4,108,491 A 8/1978 Rogers, Jr.
4,194,783 A * 3/1980 Cycowicz ..... A47C 1/0345 248/429

(Continued)

FOREIGN PATENT DOCUMENTS

FR 1255403 A 3/1961

OTHER PUBLICATIONS

Extended Search Report dated Feb. 19, 2018 in European Patent Application No. 17183598.6, 8 pages.
Extended Search Report dated Feb. 19, 2018 in European Patent Application No. 17182541.7, 7 pages.

*Primary Examiner* — Mark R Wendell
(74) *Attorney, Agent, or Firm* — Shook, Hardy & Bacon L.L.P.

(57) ABSTRACT

A blocker linkage for use in selectively locking a glider-recliner is provided. The glider-recliner is operable to move between closed, TV and full-recline positions. The blocker linkage includes a glide bracket having front and rear glide links pivotably coupled thereto. The rear glide link has a blocker pin coupled to it that extends outwardly. A carrier link is pivotably coupled to the bottoms of the front and rear glide links. A rear blocker cam is pivotably coupled to the carrier link. Similarly, a front blocker cam is also pivotably coupled to the carrier link. The rear blocker cam and the front blocker cam are operably coupled to cooperatively engage the blocker pin on the rear glide link when the glider-recliner is moved from the closed position to the TV and full-recline positions, preventing movement of the rear glide link (and thus the gliding movement supported by the carrier link).

16 Claims, 19 Drawing Sheets

(56) References Cited

U.S. PATENT DOCUMENTS

| | | | | |
|---|---|---|---|---|
| 4,591,205 | A * | 5/1986 | James | A47C 3/0255 108/132 |
| 5,765,913 | A * | 6/1998 | LaPointe | A47C 1/035 248/370 |
| 5,795,021 | A * | 8/1998 | Rogers | A47C 3/0255 297/259.2 |
| 8,398,165 | B2 * | 3/2013 | Lawson | A47C 3/027 297/259.2 |
| 8,398,169 | B2 * | 3/2013 | LaPointe | A47C 1/0355 297/260.2 |
| 8,616,627 | B2 * | 12/2013 | Murphy | A47C 1/0355 297/271.1 |
| 8,833,844 | B2 * | 9/2014 | LaPointe | A47C 1/0355 297/259.2 |
| 8,915,544 | B2 * | 12/2014 | LaPointe | A61G 5/14 297/85 M |
| 2002/0043823 | A1 * | 4/2002 | Wiecek | A47C 1/035 297/84 |
| 2010/0127556 | A1 * | 5/2010 | Hoffman | A47C 1/0355 297/85 R |
| 2012/0112519 | A1 * | 5/2012 | Murphy | A47C 1/0355 297/85 M |
| 2013/0200659 | A1 * | 8/2013 | Hoffman | A47C 1/035 297/84 |
| 2016/0100687 | A1 * | 4/2016 | Murphy | A47C 1/0347 297/271.3 |

* cited by examiner

GLIDER RECLINE LINKAGE WITH DOUBLE BLOCKER CAMS

CROSS-REFERENCE

This application claims priority to U.S. Provisional Patent Application No. 62/368,283, filed on Jul. 29, 2016, which is hereby incorporated by reference in its entirety.

BACKGROUND

Glider-recliner (glider) chairs are generally well known in the furniture industry. The term glider is used throughout this description to describe articles of furniture that include a reclining mechanism with a glider feature. Gliders are chairs that allow the user to reciprocate back-and-forth in a gliding motion. Gliders are known in both a manual configuration (where the user releases the mechanism from closed to TV, and moves the mechanism from TV to full recline) and a motorized version (where a motor is used to move the mechanism between the various positions).

The reclining motion is achieved in glider chairs with a linkage mechanism that is coupled to the base and/or to a gliding linkage. The linkage mechanisms found in gliders in the art include a plurality of interconnected links that provide one or more mechanisms for extending a footrest, reclining the chair, and obstructing movements of the chair when in specific orientations. Typically, gliders known in the art provide three positions: an upright seated position with the footrest retracted beneath the chair (the closed position), a television viewing or TV position in which the chair back is slightly reclined but still provides a generally upright position with the footrest extended, and a full-recline position in which the chair back is reclined an additional amount farther than in the TV position but still generally inclined with respect to the seat of the chair and with the foot rest extended. For gliders, the chair is permitted to glide when the mechanism is in the closed position. The mechanism "locks" the glide mechanism to prevent gliding movement when the chair is in the TV or full-recline position.

Previous mechanisms used to lock the glide mechanism sometimes inadvertently locked the glider, when undesired, or resulted in an abrupt stop, which could be unpleasant to users. It would be desirable to provide a glider (whether manual or powered) having a locking structure that is more reliable and that more-smoothly locks the glider when desired.

SUMMARY

Embodiments of the invention are defined by the claims below, not this summary. A high-level overview of various aspects of the invention are provided here for that reason, to provide an overview of the disclosure, and to introduce a selection of concepts that are further described below in the detailed-description section. This summary is not intended to identify key features or essential features of the claimed subject matter, nor is it intended to be used as an aid in isolation to determine the scope of the claimed subject matter.

In an aspect of the invention a blocker linkage for use in selectively locking a glider-recliner is provided. The glider-recliner is operable to move between closed, TV and full-recline positions. The blocker linkage includes a glide bracket having a forward end and a rearward end. A top end of a front glide link is pivotably coupled to the forward end of the glide bracket. Similarly, a top end of a rear glide link is pivotably coupled to the rearward end of the glide bracket. The rear glide link has a blocker pin coupled to it that extends outwardly. A carrier link is pivotably coupled to the bottom of the front glide link and pivotably coupled to the bottom of the rear glide link. A rear blocker cam is pivotably coupled to the carrier link. Similarly, a front blocker cam is also pivotably coupled to the carrier link. The rear blocker cam and the front blocker cam are operably coupled to cooperatively engage the blocker pin on the rear glide link when the glider-recliner is moved from the closed position to the TV and full-recline positions, preventing movement of the rear glide link (and thus the gliding movement supported by the carrier link).

DESCRIPTION OF THE DRAWINGS

Illustrative embodiments of the invention are described in detail below with reference to the attached drawing figures, and wherein.

DETAILED DESCRIPTION

The subject matter of aspects of the invention is described with specificity herein to meet statutory requirements. But the description itself is not intended to necessarily limit the scope of claims. Rather, the claimed subject matter might be embodied in other ways to include different steps, components, or combinations thereof, in conjunction with other present or future technologies.

Figure 1:
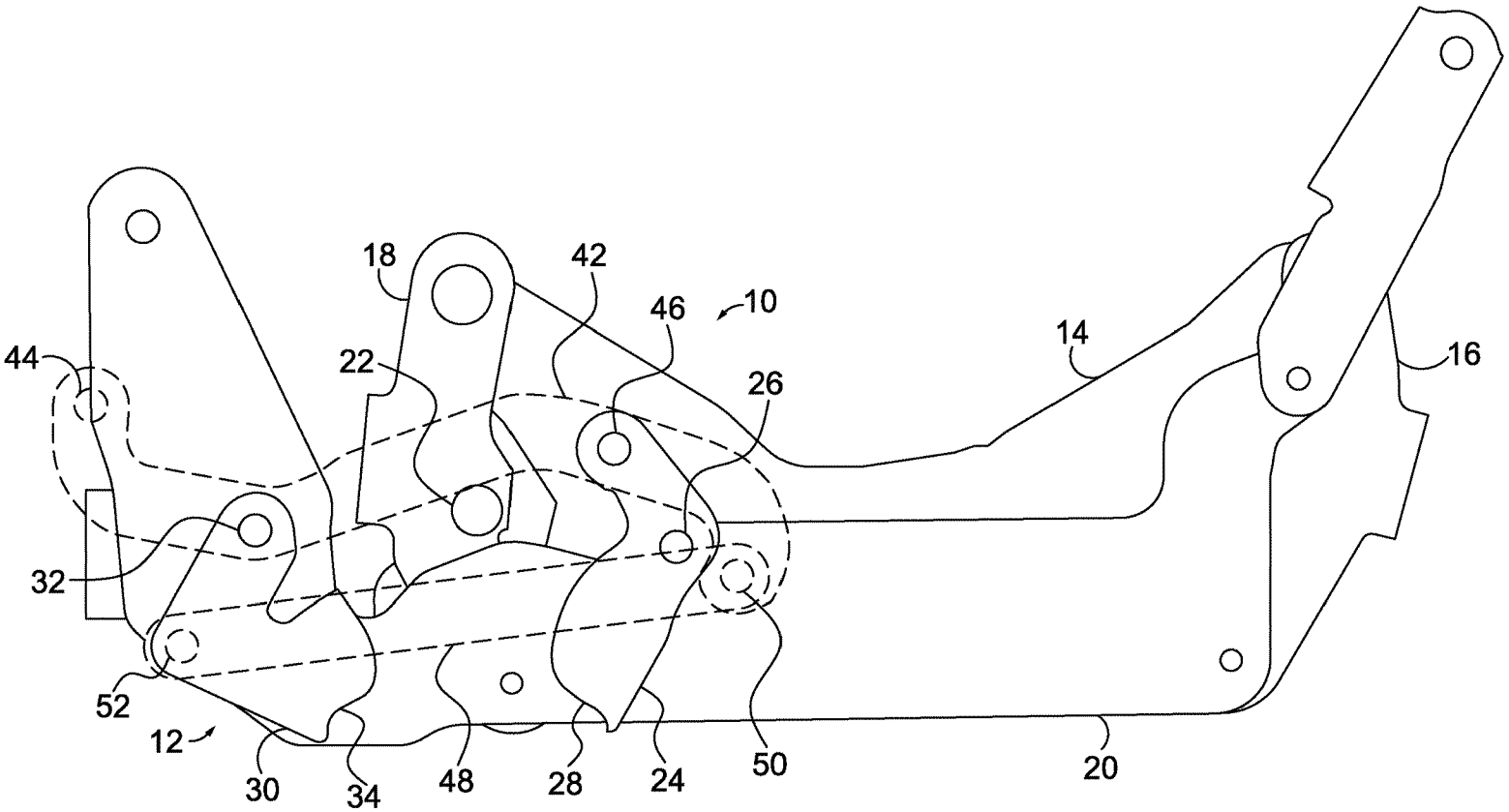
FIG. 1 is a side view of selected components of an exemplary glider-recliner chair mechanism in a closed position, showing the blocking linkage disengaged, in accordance with an aspect of the invention.
Figure 2:
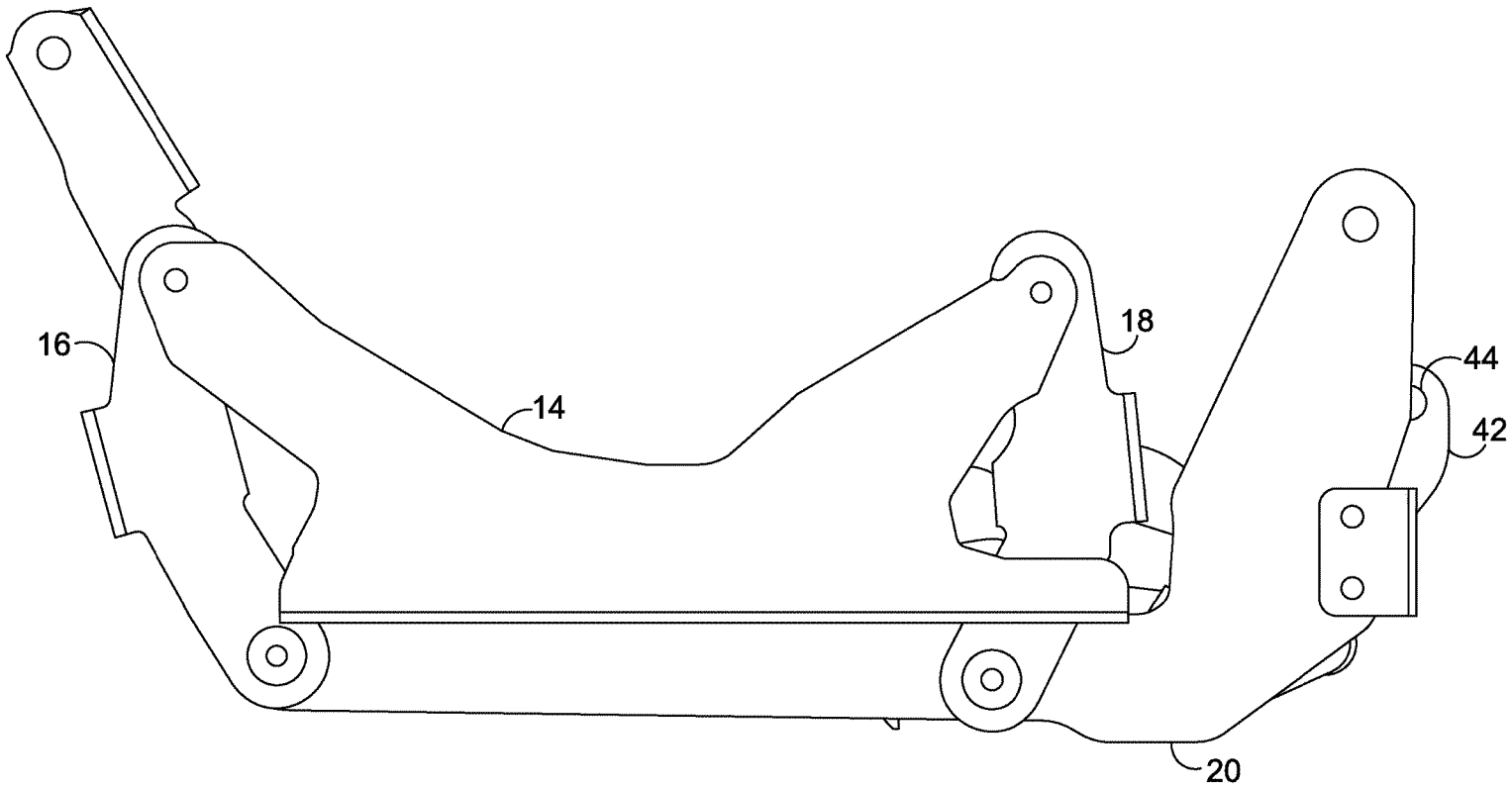
FIG. 2 is a side view of the other side of FIG. 1, showing selected components of an exemplary glider-recliner chair mechanism in a closed position, showing the blocking linkage disengaged, in accordance with an aspect of the invention.
Figure 3:
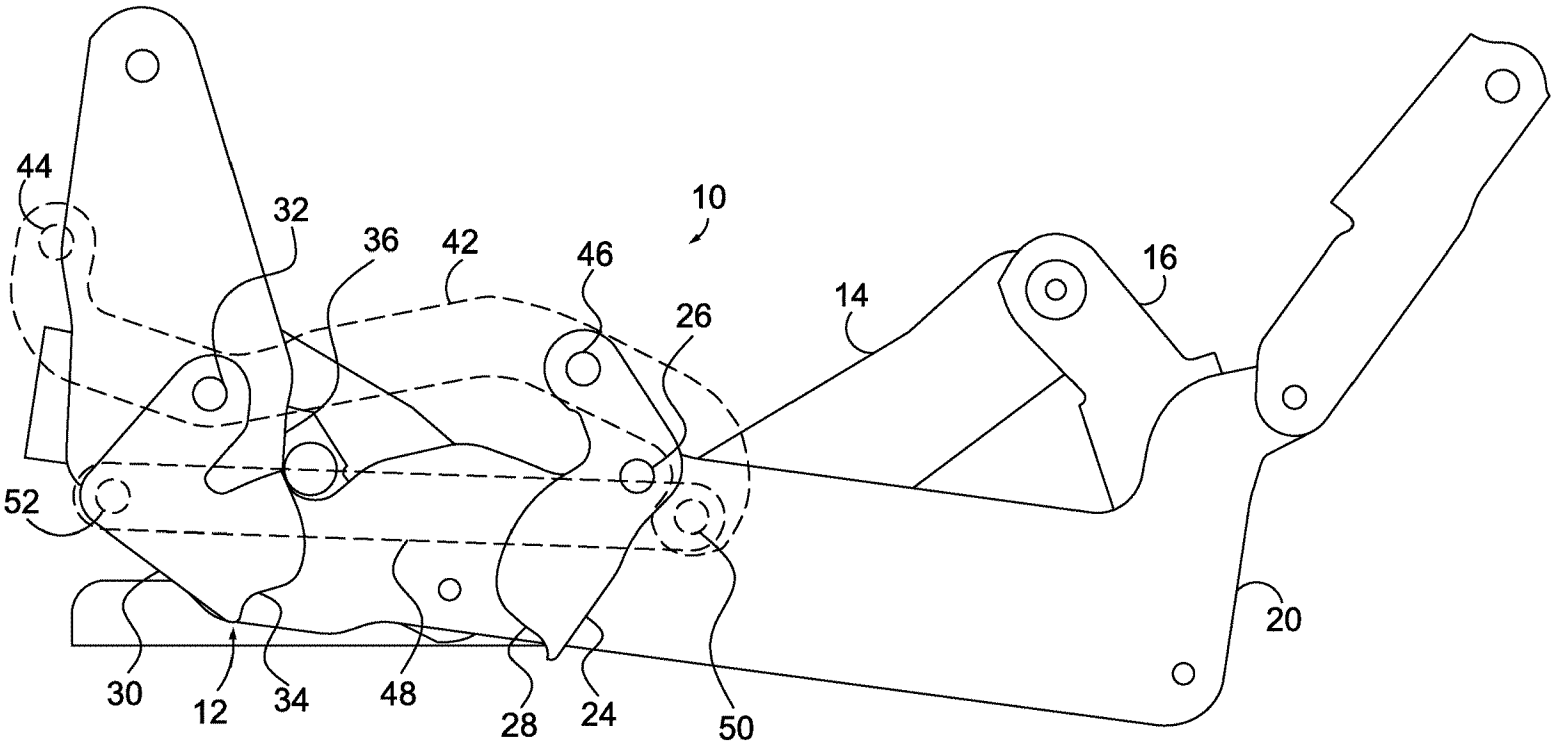
FIG. 3 is a view similar to FIG. 1, showing the components in a forward-glide position.
Figure 4:
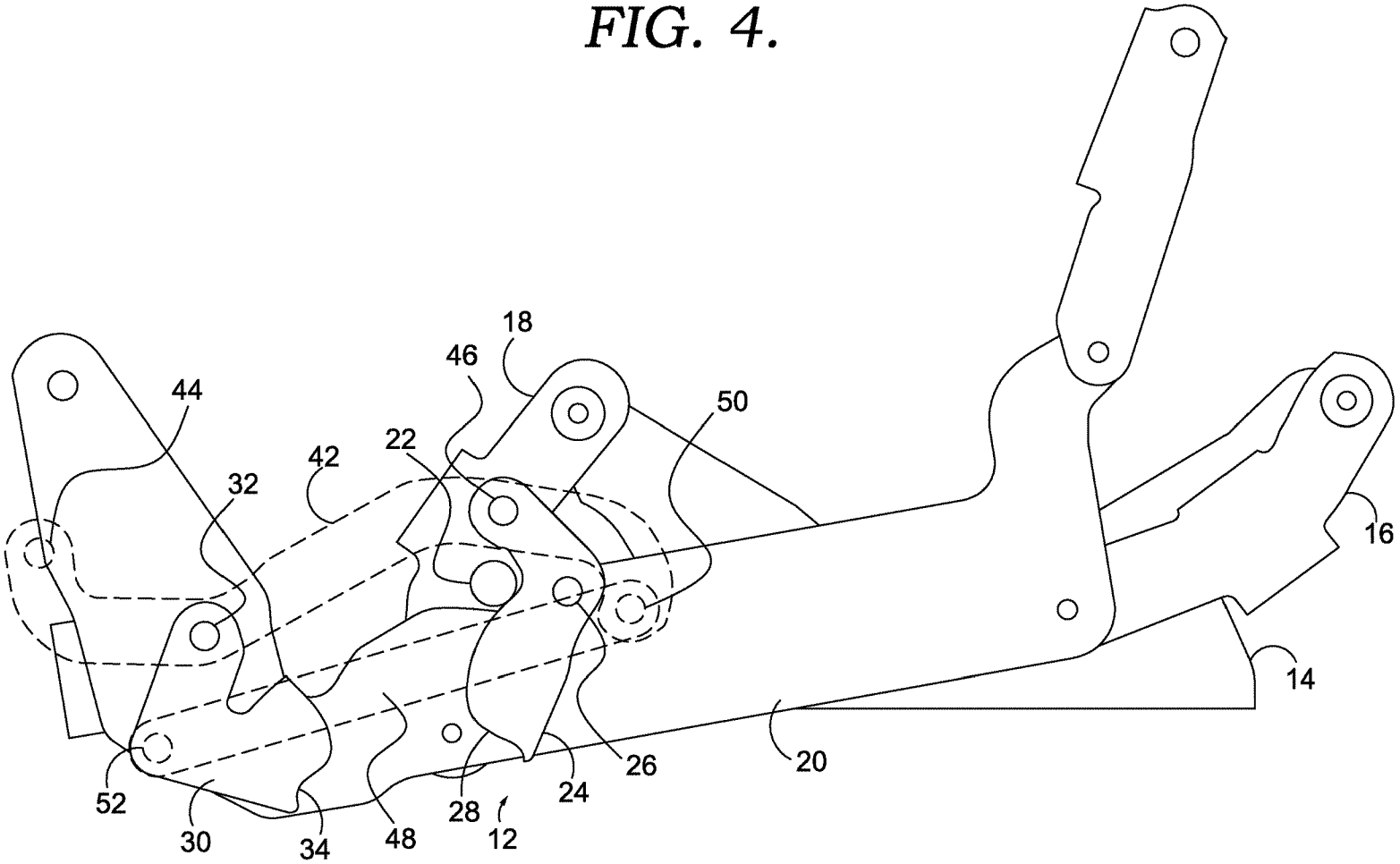
FIG. 4 is a view similar to FIG. 1, showing the components in a rearward-glide position.

Referring to the drawings and initially to FIGS. 1-5, certain components of a glider-recliner base 10 are shown, in the closed position in accordance with aspects of the invention. The glider-recliner base 10 is more-fully described later, with reference to FIGS. 6-10. Glider-recliner base 10 includes a blocker linkage 12 that allows a gliding motion when the glider-recliner base 10 is in the closed position, but blocks a gliding motion when the glider-recliner base 10 is in the TV or full-recline positions. The blocker linkage 12 includes a glide bracket 14 that is typically coupled to a frame supporting the remainder of the mechanism. A top end of a front glide link 16 is pivotably coupled to a front portion of glide bracket 14, and a top end of a rear glide link 18 is pivotably coupled to a rear portion of glide bracket 14. As best seen in FIG. 2, the bottom ends of front glide link 16 and rear glide link 18 are pivotably coupled to a carrier link 20. As best seen in FIG. 1, rear glide link 18 includes a blocker pin 22, which is rigidly secured to the rear glide link 18 generally midway between the top and bottom of the rear glide link 18. Carrier link 20 is thus supported on glide bracket 14 by front glide link 16 and rear glide link 18 such that the carrier link can reciprocate in a back-and-forth motion (gliding) relative to the glide bracket 14 (and thus the supporting frame) when the glider-recliner is in the closed position.

When the glider-recliner is in a closed position, the carrier link 20 should thus be able to reciprocate in the back-and-forth gliding motion relative to the glide bracket 14. However, when the chair is in the TV or full-recline positions, the carrier link 20 should be locked in placed relative to the glide bracket 14. To facilitate this locking, a front blocker cam 24 is pivotably coupled to carrier link 20 at pivot point 26. The front blocker cam rotates clock-wise (as viewed in FIGS. 1 and 3-5) about pivot point 26. The front block cam has a cam surface 28, as best seen in FIG. 1. Similarly, a rear blocker cam 30 is pivotably coupled to carrier link 20 at pivot point 32. The rear blocker cam rotates counter-clockwise (as viewed in FIGS. 1 and 3-5) about pivot point 32. The rear blocker cam 30 includes a cam surface 34, as best seen in FIG. 1.

Figure 5:
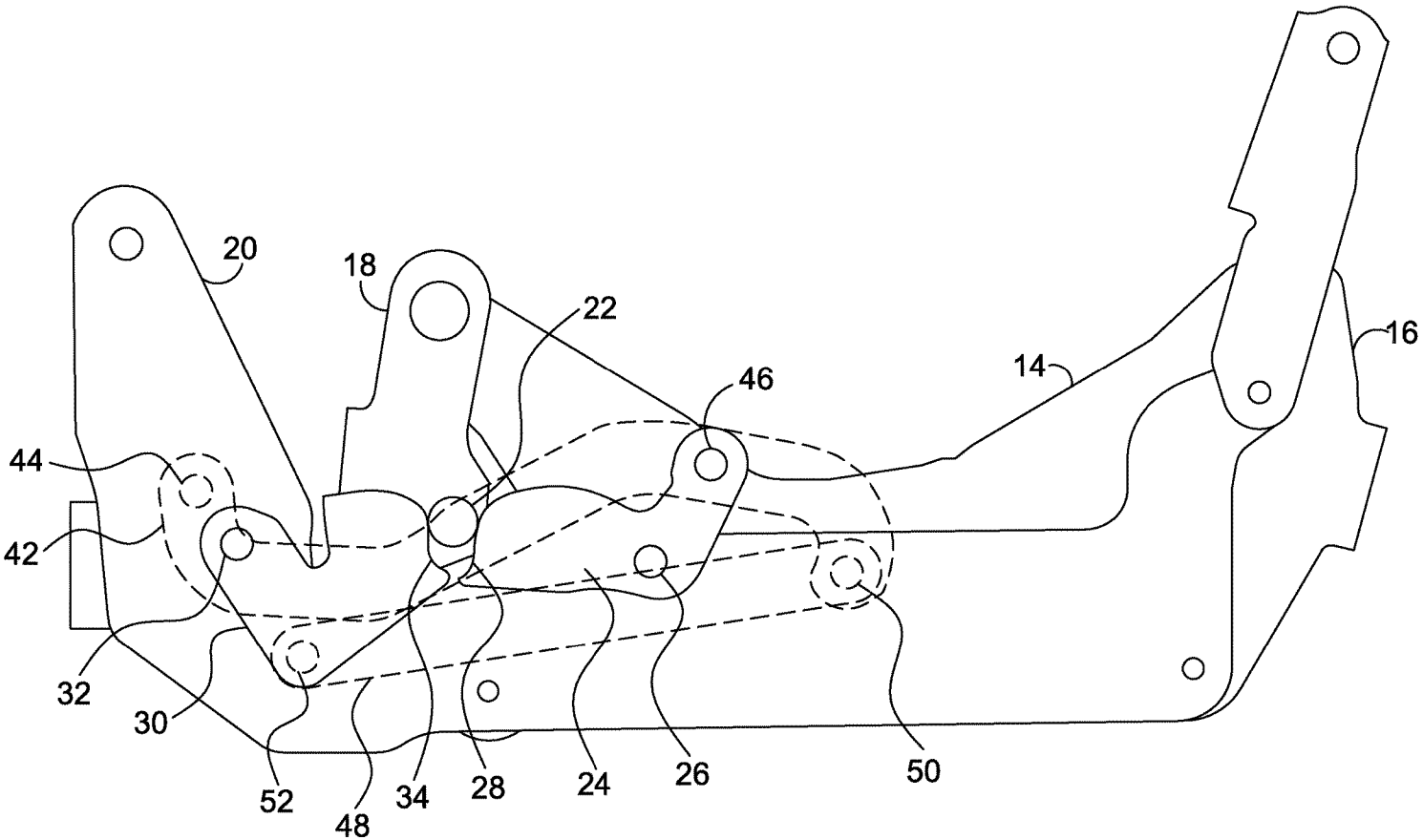
FIG. 5 is a side view of the selected components of FIG. 1 with the glider recliner in the TV position, showing the blocking linkage engaged, in accordance with an aspect of the invention.

The front blocker cam 24 and the rear blocker cam 30 rotate from the position shown in FIG. 1, which illustrates the glider-recliner in the closed position, to the position shown in FIG. 5, which illustrates the glider recliner in the TV position. As can be seen, in the closed position of FIG. 1, the cam surface 28 of front blocker cam 24 and the cam surface 34 of rear blocker cam 30 do not engage the blocker pin 22 on the rear glide link 18. In this closed position, the glider-recliner can "glide" between a forward-most glide position, shown in FIG. 3, and a rearward-most glide position, shown in FIG. 4. In the forward-most glide position, the blocker pin 22 abuts a rear notched surface 36 on carrier link 20. The carrier link 20 is thus prevented from further forward movement by the blocker pin 22 in this position. In the rearward-most glide position, the blocker pin 22 abuts an angled face on carrier link 20. The carrier link 20 is thus prevented from further rearward movement by the blocker pin 22 in this position. As the glider mechanism moves to the TV position (see FIG. 5), the front blocker cam 24 is rotated about pivot point 26, and the rear blocker cam 30 is rotated about pivot point 32. This rotation moves cam surface 28 and cam surface 34 into contact with the blocker pin 22, as best seen in FIG. 5.

Rotation of front blocker cam 24 and rear blocker cam 30, in concert with moving from the closed to the TV position, can be achieved in several ways. In a first aspect, as shown in FIGS. 1-10, the rotation is driven by movement of a footrest drive link 40 (see FIG. 6). In this exemplary aspect, a blocker control link 42 is pivotably coupled to footrest drive link 40 at pivot point 44. Blocker control link 42 extends forwardly and is pivotably coupled near its forward end to front blocker cam 24 at pivot point 46. The forward-most end of blocker control link 42 is pivotably coupled to a blocker connector link 48 at pivot point 50. The opposite end of blocker connector link 48 is pivotably coupled to rear blocker cam 30 at pivot point 52.

Figure 8:
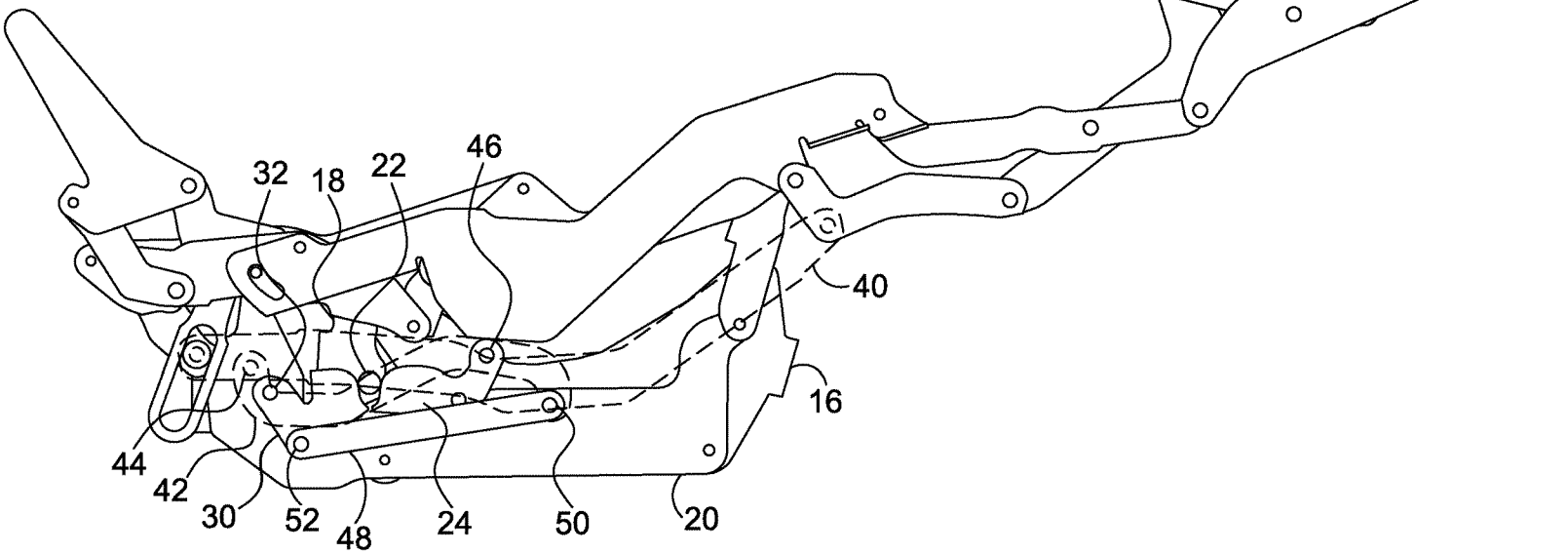
FIG. 8 is a view of the mechanism in the TV position, with certain components shown in dashed lines to reveal other components.
Figure 9:
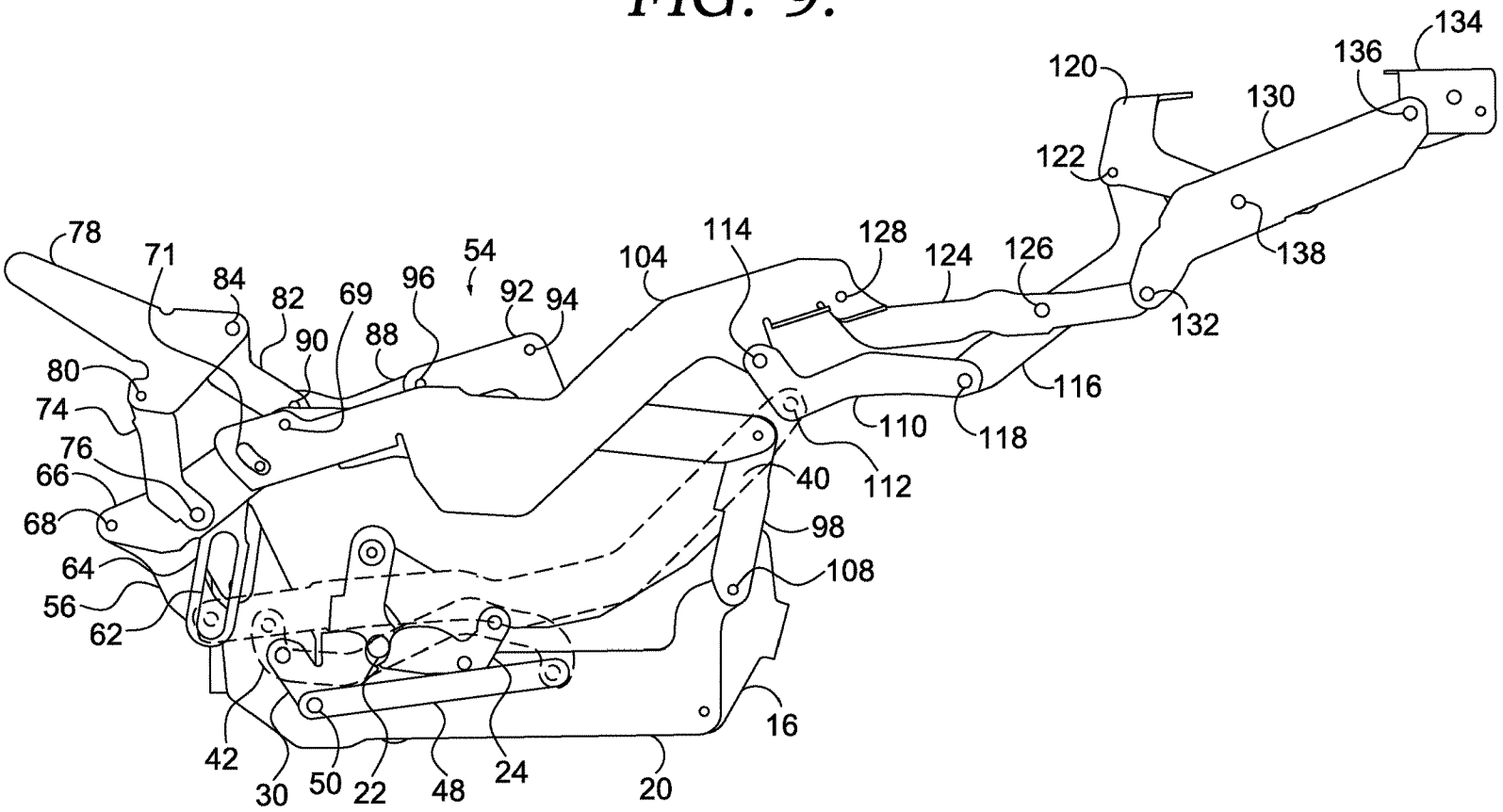
FIG. 9 is a view of the mechanism in the full-recline position with certain components shown in dashed lines to reveal other components.

As the glider-recliner moves from the closed position to the TV position, the footrest drive link 40 moves forwardly, moving the blocker control link 42 forwardly, and driving rotation of front blocker cam 24 about pivot point 26. Additionally, as the footrest drive link 40 drives the blocker control link 42 forwardly, the blocker connector link 48 also moves forwardly, driving rotation of the rear blocker cam 30 about pivot point 32. Therefore, as the glider-recliner moves from the closed position to the TV position, the front blocker cam 24 and the rear blocker cam 30 are rotated in opposite directions. In the TV position (FIGS. 5, 8), cam surface 28 of front blocker cam 24, and cam surface 34 of rear blocker cam 30 trap the blocker pin 22 on the rear glide link 18, preventing any gliding movement. This trapped condition of blocker pin 22 remains as the glider recliner is moved to the fully-extend position, as shown in FIG. 9. When the glider-recliner is returned to the closed position, the footrest drive link 40 moves rearwardly, and through the connections of the blocker control link 42 and blocker connector link 48, the front blocker cam 24 and the rear blocker cam 30 are returned to the position shown in FIG. 7, once again allowing gliding movement.

The remainder of the glider-recliner base 10 can be constructed from any of many designs. As one example, the remainder of a recline mechanism 54 of glider-recliner base 10 is shown in FIGS. 7-10 and described below. Only one side of glider recliner base 10 is shown in the Figures, for clarity, with the removed side being a mirror-image of the side that is shown. Moreover, the recline mechanism 54 is coupled to a manual or motorized base assembly as would be understood by those of skill in the art. The recline mechanism 54 is coupled to the glider-recliner base 10 at one point through a rear pivot link 56 pivotably coupled to carrier link 20 at pivot point 58. Rear pivot link 56 has a generally triangular shape, as shown. As best seen in FIG. 9, the lower end of rear pivot link 56 is pivotably coupled to a footrest drive link 40 through a roller 60 that rides within a slot 62 on a sequence link 64. The opposite end of sequence link 64 is pivotably coupled to a rear lift link 66 at pivot point 67, seen in FIG. 10. Sequence link 64 thus extends between rear lift link 66 and rear pivot link 56, and is also coupled to footrest drive link 40.

Figure 10:
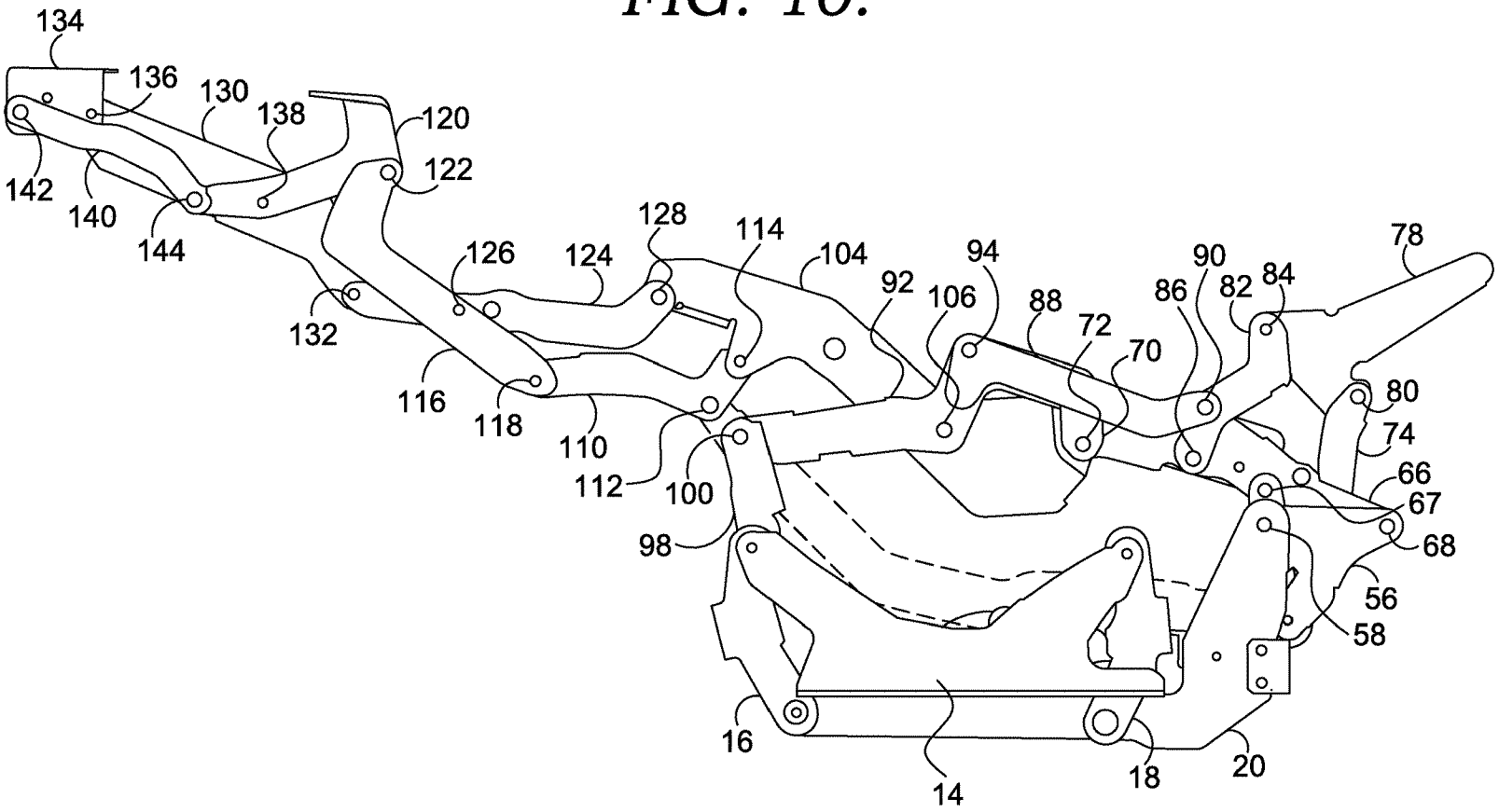
FIG. 10 is a side view similar to FIG. 9, but from the other side.
Figure 11:
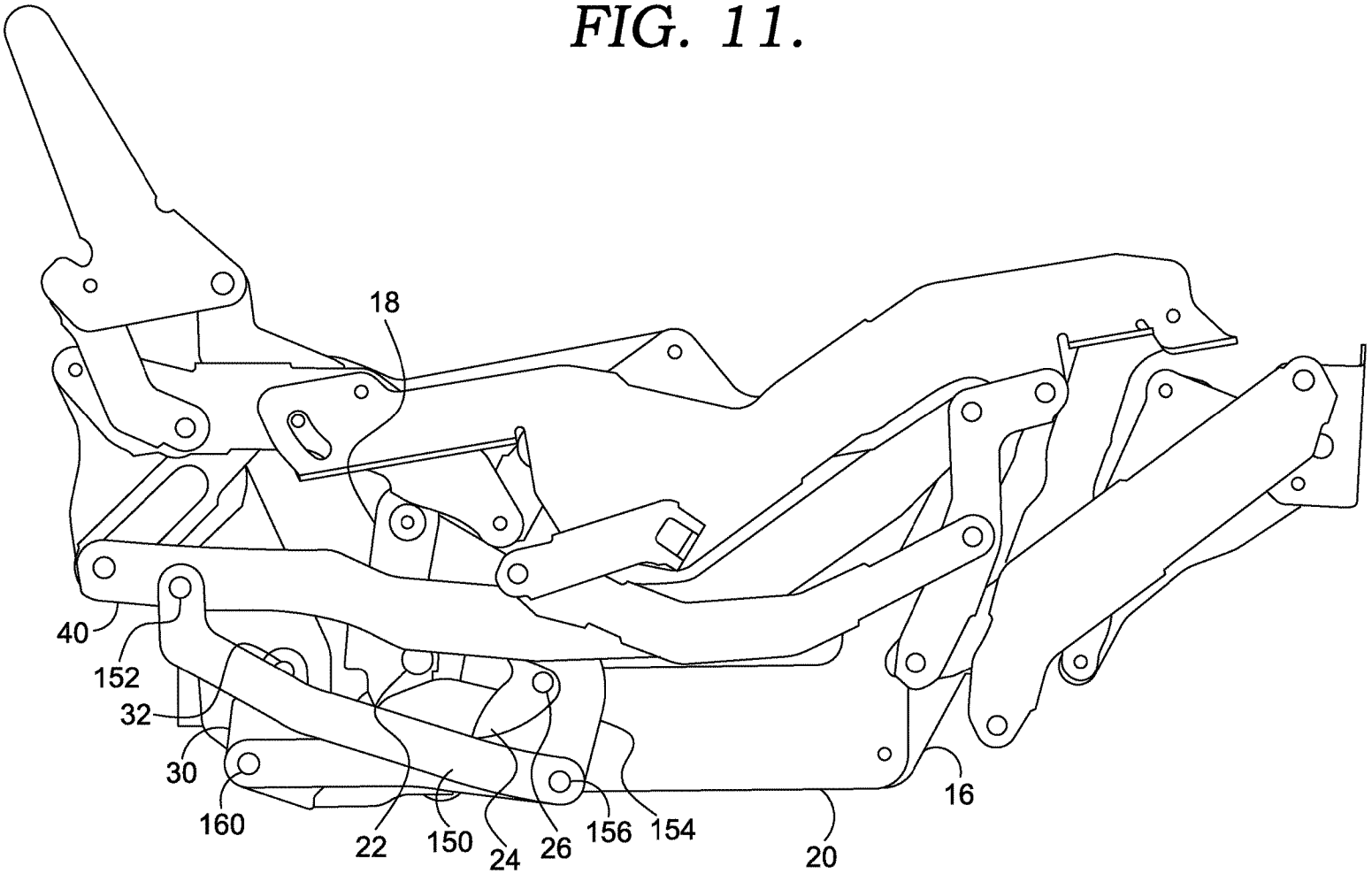
FIG. 11 is a view similar to FIG. 6, in accordance with an additional aspect of the invention.
Figure 12:
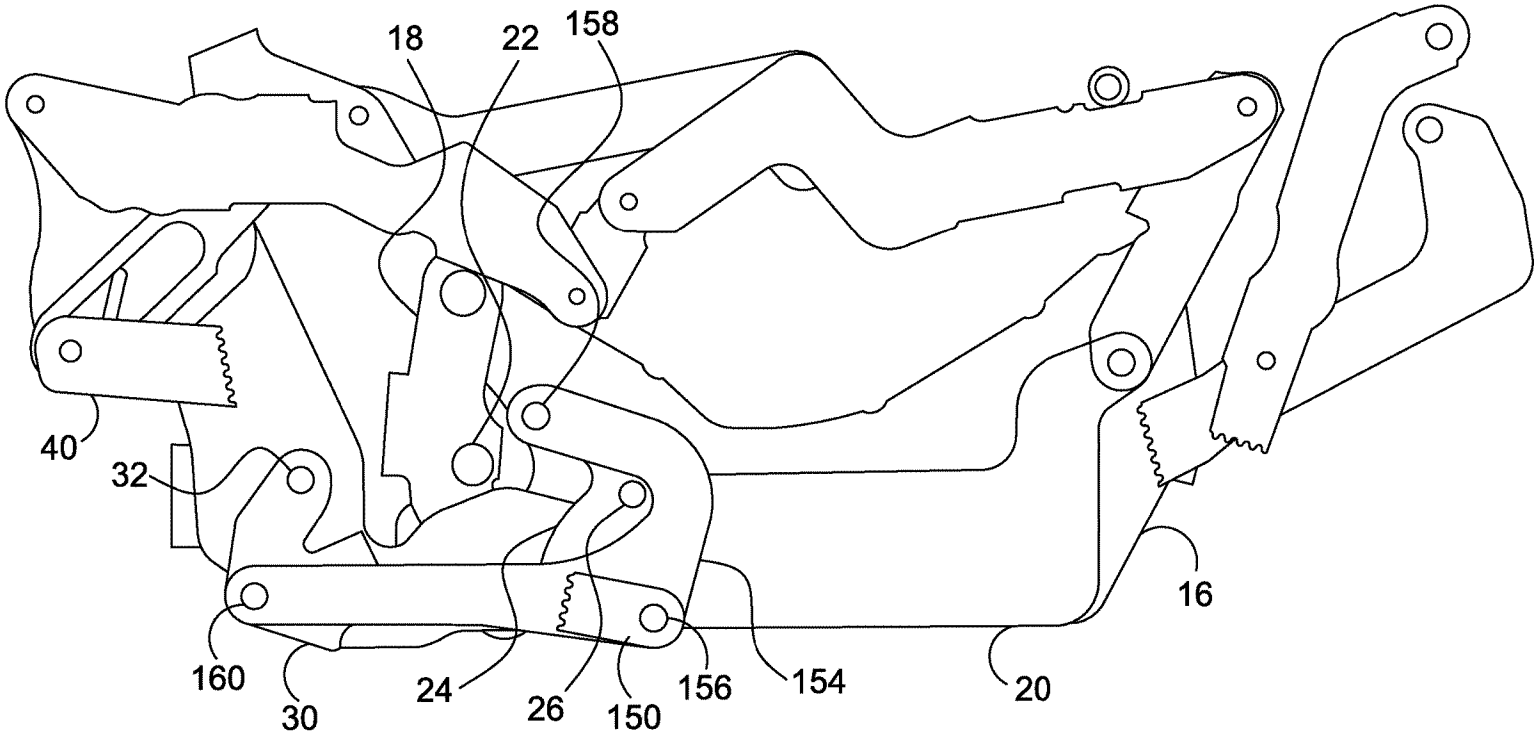
FIG. 12 is a view of FIG. 11, with certain components, or portions of components, removed for clarity to reveal other components.
Figure 15:
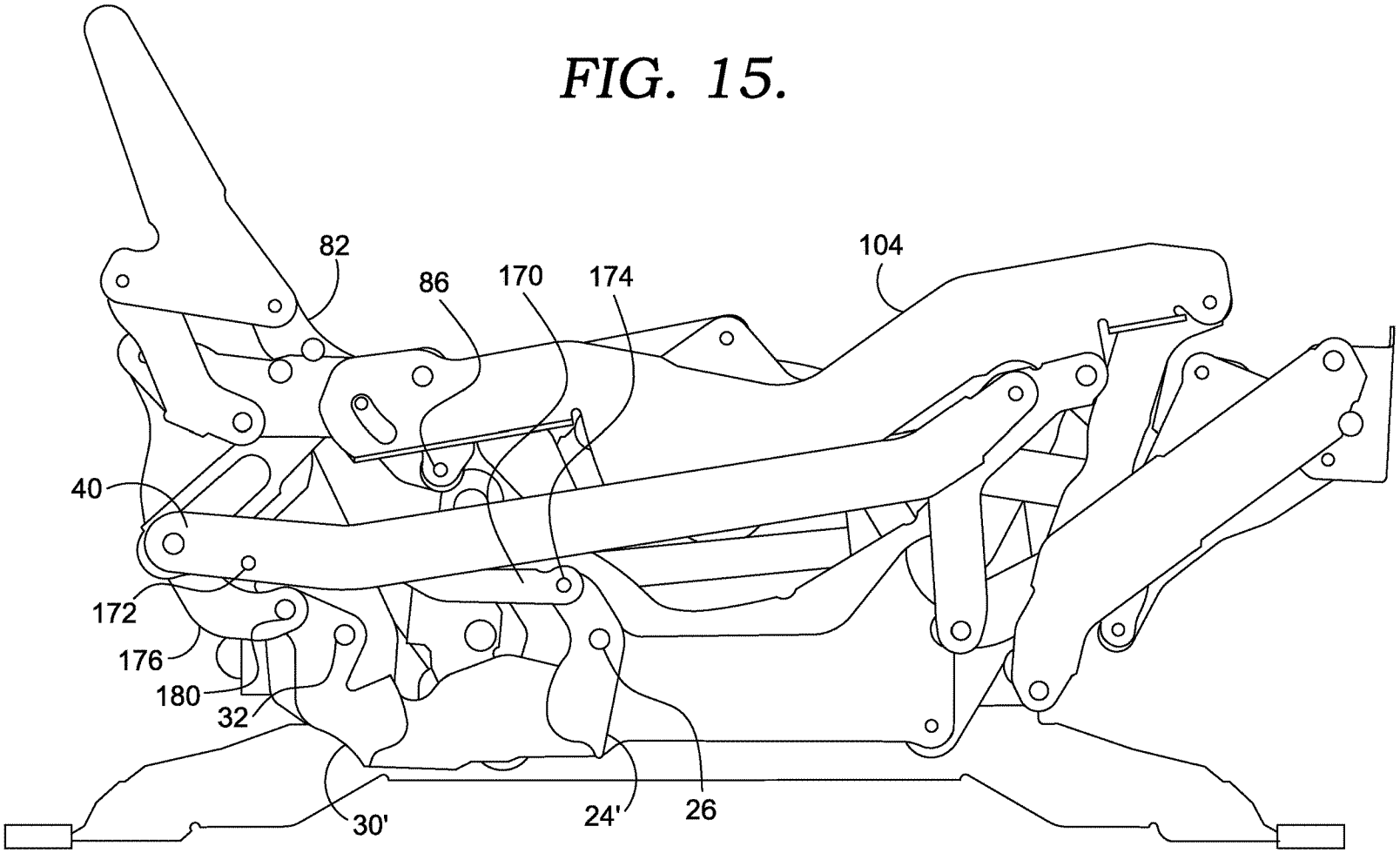
FIG. 15 is a view similar to FIG. 6, in accordance with an additional aspect of the invention.
Figure 16:
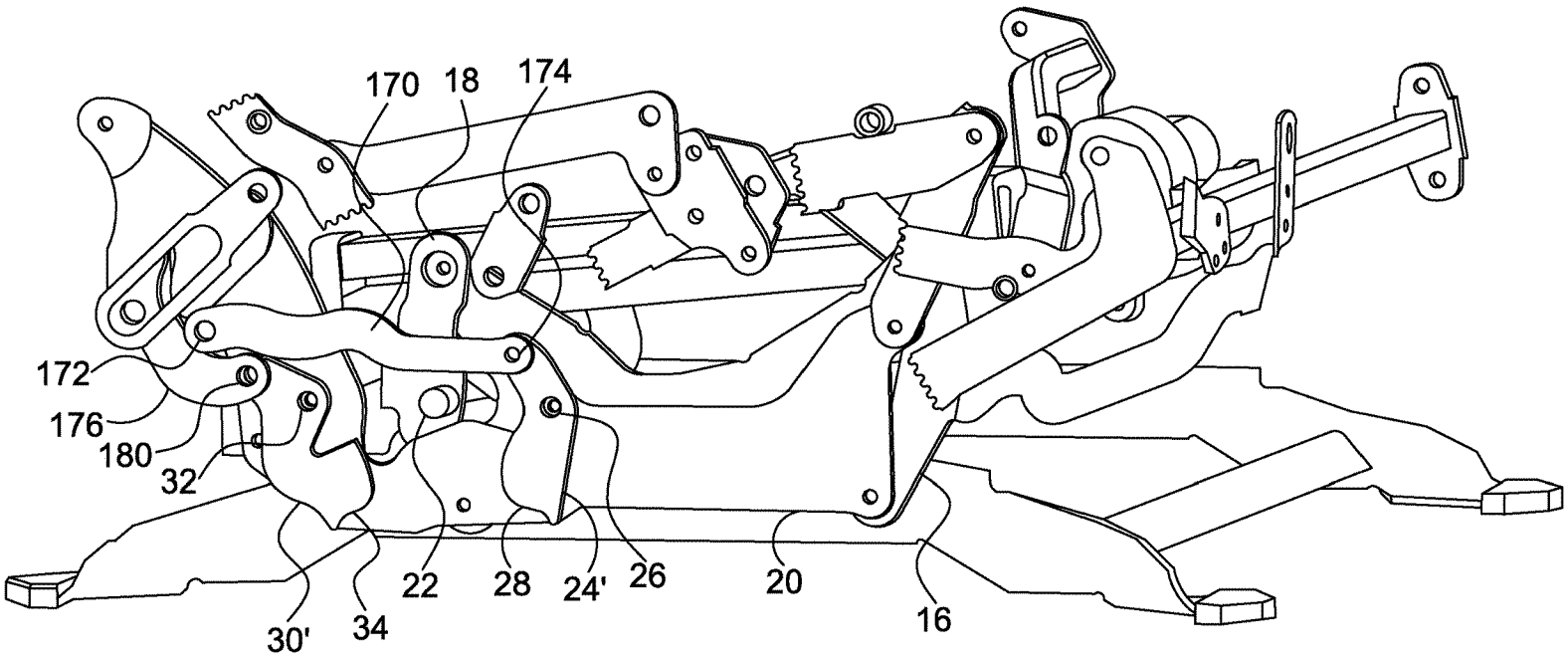
FIG. 16 is a perspective view of FIG. 15 with certain components, or portions of components, removed, for clarity.
Figure 17:
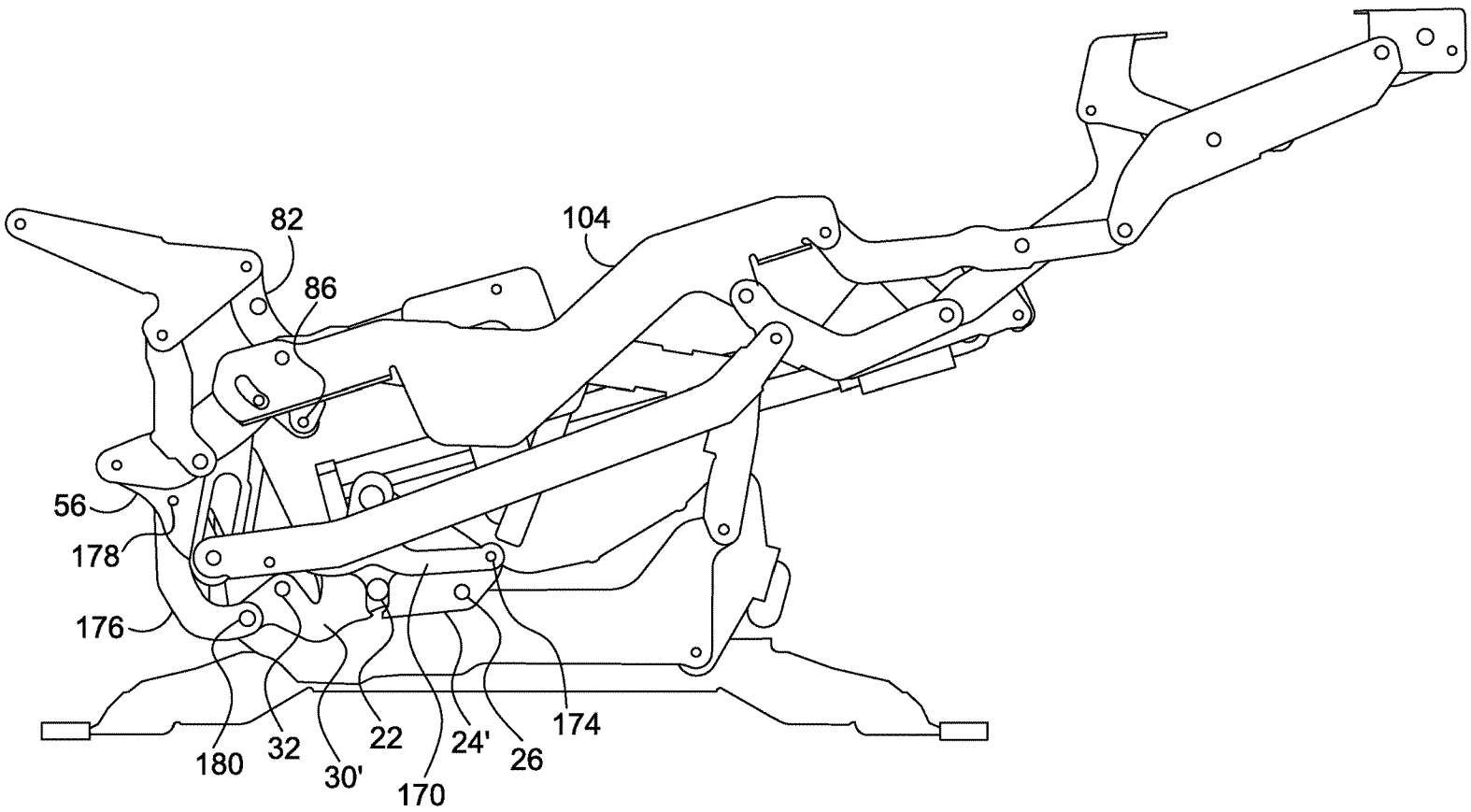
FIG. 17 is a view of the mechanism of FIG. 15 in the full-recline position.
Figure 18:
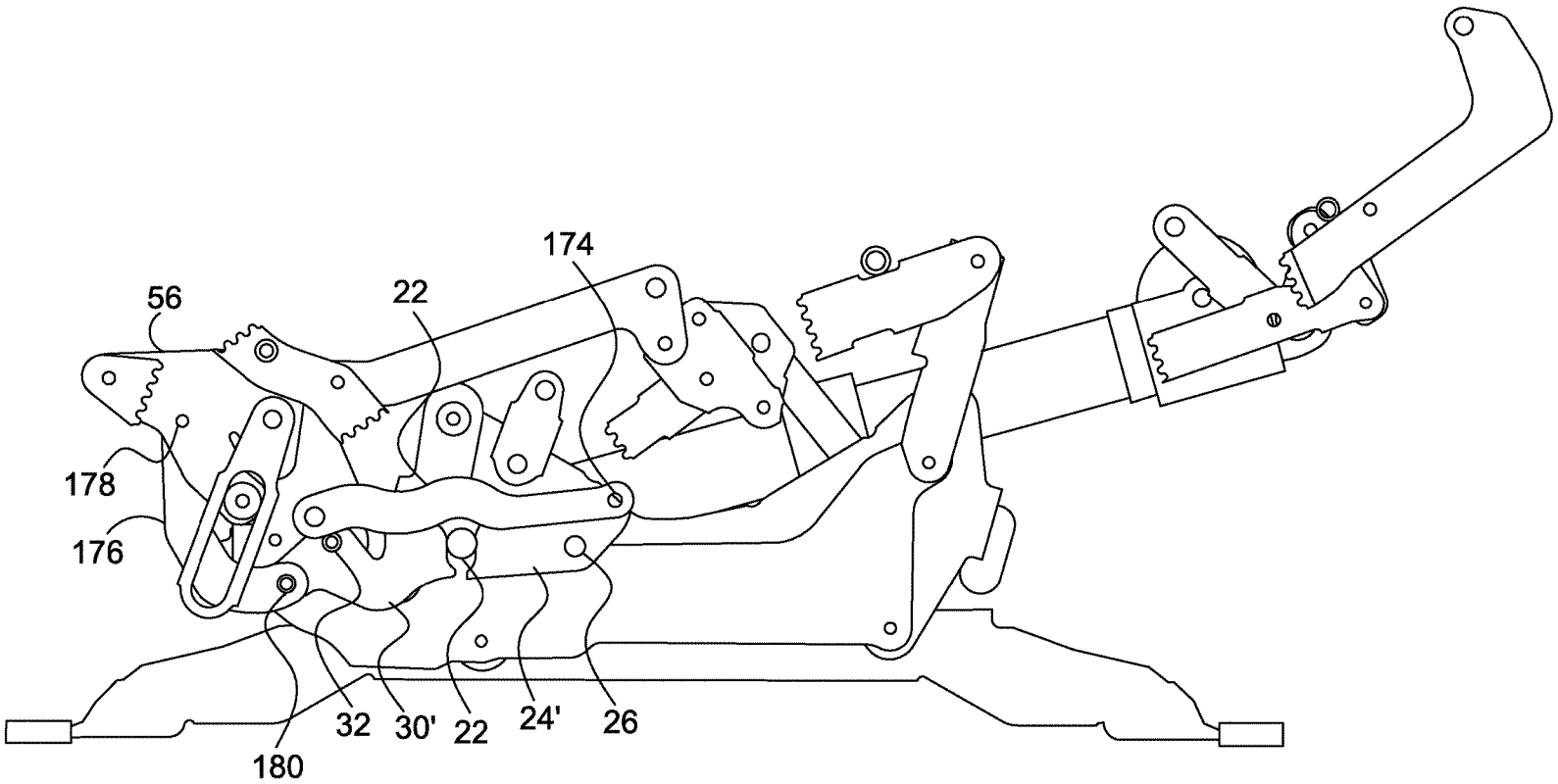
FIG. 18 is a view similar to FIG. 17 with certain components, or portions of components, removed, for clarity.

As best seen in FIG. 10, the rear lift link 66 is pivotably coupled on its rearward end to rear pivot link 56 at pivot point 68. The opposite end of rear lift link 66 is pivotably coupled to a connector link 70 at pivot point 72. The rear lift link 66 thus extends between, and is pivotably coupled to, the rear pivot link 56 and the connector link 70. As best seen in FIG. 9, a rear back pivot link 74 is pivotably coupled to rear lift link 66 at pivot point 76. The rear lift link 66 is also pivotably connected to a seat mounting plate 104 at pivot point 69, as best seen in FIG. 9. The travel of rear lift link relative to sear mounting plate 104 is limited by a pin and slot coupling 71. The opposite end of rear back pivot link 74 is pivotably coupled to back bracket 78 at pivot point 80. The back bracket 78 is shaped as shown, with an upper extending leg that is used to couple the back bracket 78 to a back of the chair. The forward, lower area of back bracket 78 is pivotably coupled to an upper end of a forward back pivot link 82 at pivot point 84. The lower end of forward back pivot link 82 is pivotably coupled to rear lift link 66 at pivot point 86. An alternative coupling of forward back pivot link 82 is shown in FIGS. 15 and 17, where forward back pivot link 82 is pivotably coupled on its lower end to seat mounting plate 104, at pivot point 86.

As best seen in FIGS. 9 and 10, a rearward end of a control link 88 is pivotably coupled to the forward back pivot link 82 at pivot point 90. The forward end of control link 88 is pivotably coupled to a front lift link 92 at pivot point 94. The front lift link 92 is pivotably coupled on its rear end to the upper end of connector link 70 at pivot point 96 (FIG. 9). A forward end of front lift link 92 is pivotably coupled to the upper end of a front pivot link 98 at pivot point 100. Below pivot point 94, front lift link 92 is also pivotably coupled to a seat mounting plate 104 at pivot point 106 (see FIG. 10). The lower end of front pivot link 98 is pivotably coupled to carrier link 20 at pivot point 108.

Figure 6:
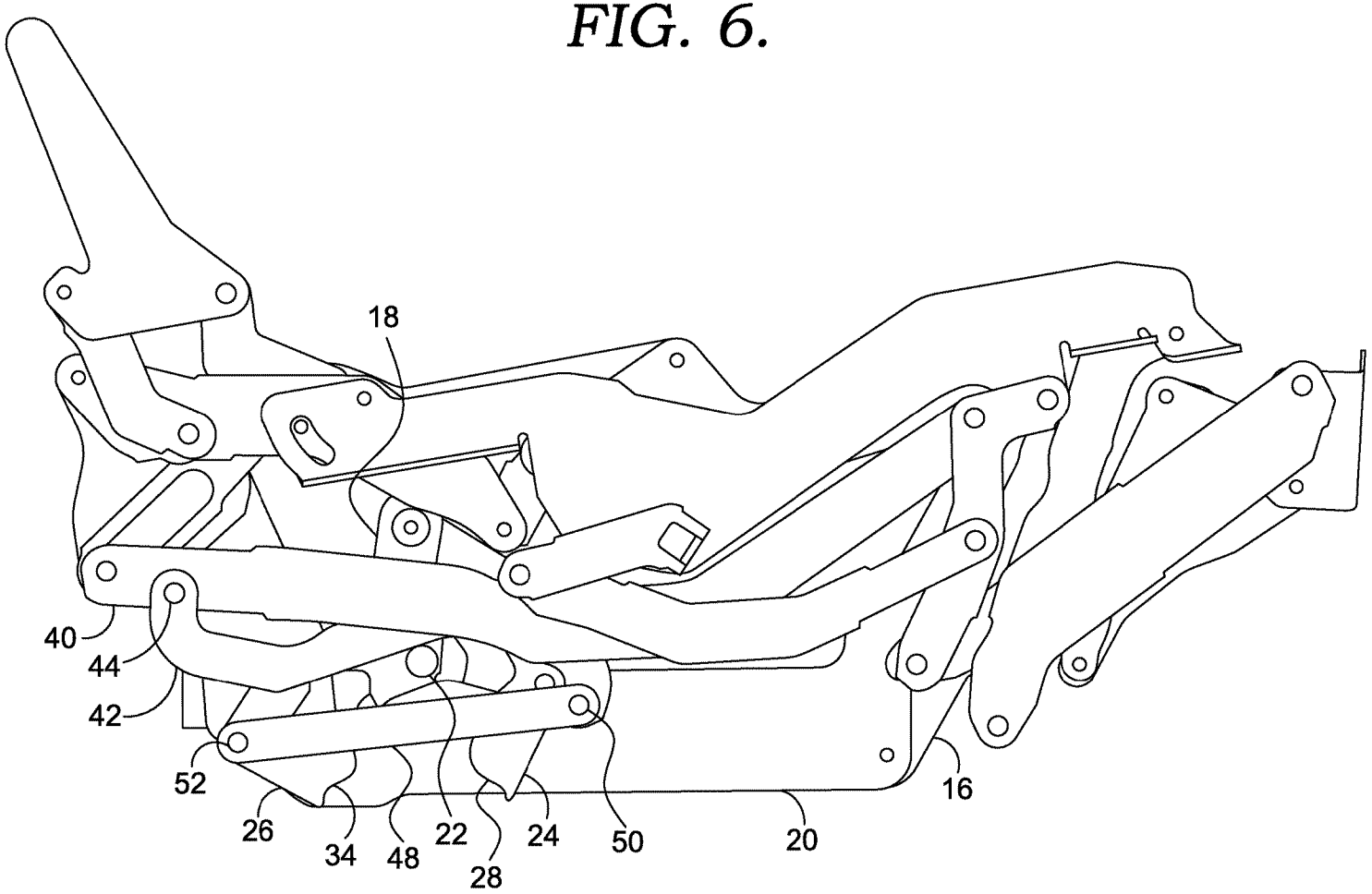
FIG. 6 a side view of one side of the components of an exemplary glider-recliner chair mechanism in a closed position, showing the blocking linkage disengaged, in accordance with an aspect of the invention.
Figure 7:
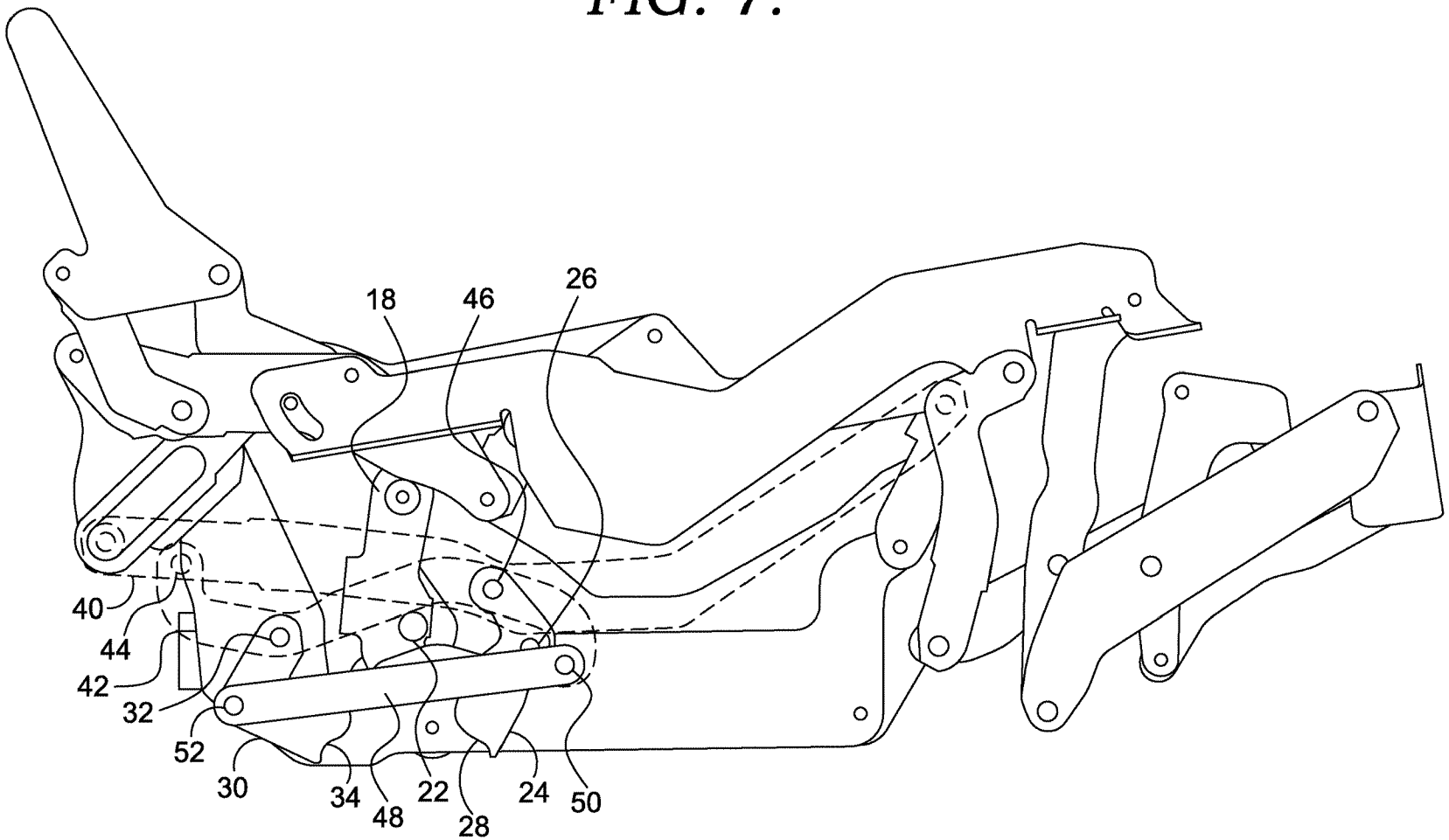
FIG. 7 is a view similar to FIG. 6, with certain components shown in dashed lines to reveal other components.

As best seen in FIG. 6, footrest drive link 40 extends from the connection to sequence link 64 and rear pivot link 56 forwardly and is pivotably connected on its forward end to a rear ottoman link 110 at pivot point 112. Rear ottoman link 110 is pivotably coupled on its upper end to seat mounting plate 104 at pivot point 114. The opposite end of rear ottoman link 110 is pivotably coupled to a footrest extension link 116 at pivot point 118 (see FIG. 9). The end of footrest extension link 116 opposite pivot point 118 is pivotably coupled to a mid-ottoman bracket 120 and pivot point 122. Additionally, footrest extension link 116 is pivotably coupled, generally at a mid-point, to a front ottoman link 124 at pivot point 126. Front ottoman link 124 is pivotably coupled on one end to seat mounting plate 104 at pivot point 128 (see FIG. 10), and is pivotably coupled on the other end to a wide ottoman link 130 at pivot point 132. The wide ottoman link 130 is pivotably coupled on its other end to an ottoman bracket 134 at pivot point 136. As seen in FIG. 10, a mid-point of the mid-ottoman bracket 120 is pivotably coupled to the wide ottoman link 130 at pivot point 138. A footrest control link 140 is pivotably coupled on one end to ottoman bracket 134 at pivot point 142, and is pivotably coupled on the other end to mid-ottoman bracket 120 at pivot point 144. The ottoman linkage described above can be moved from a closed position in FIGS. 6-7, to an extended position as shown in FIGS. 8-10.

Figure 13:
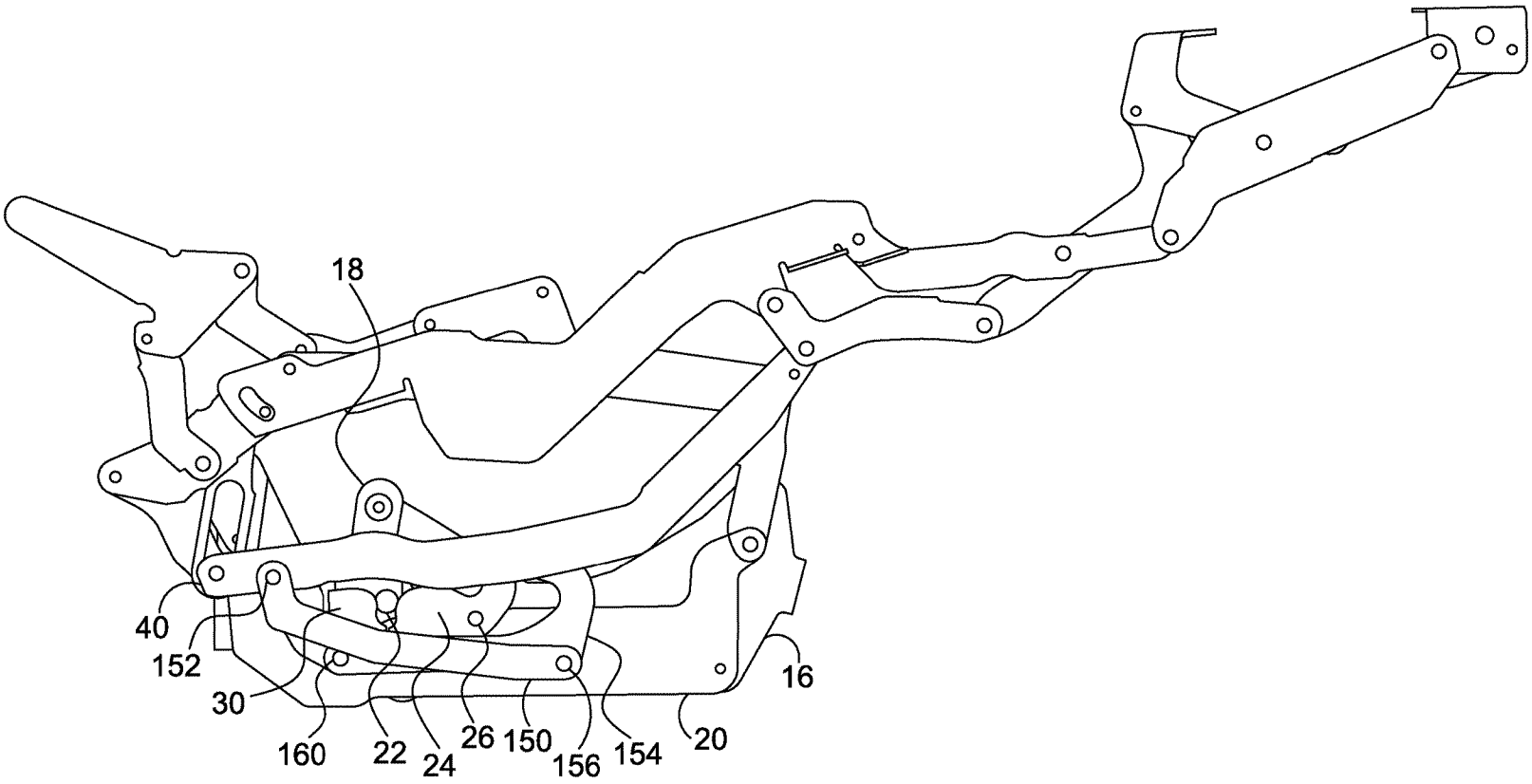
FIG. 13 is a view of the mechanism of FIG. 11 in the full-recline position.
Figure 14:
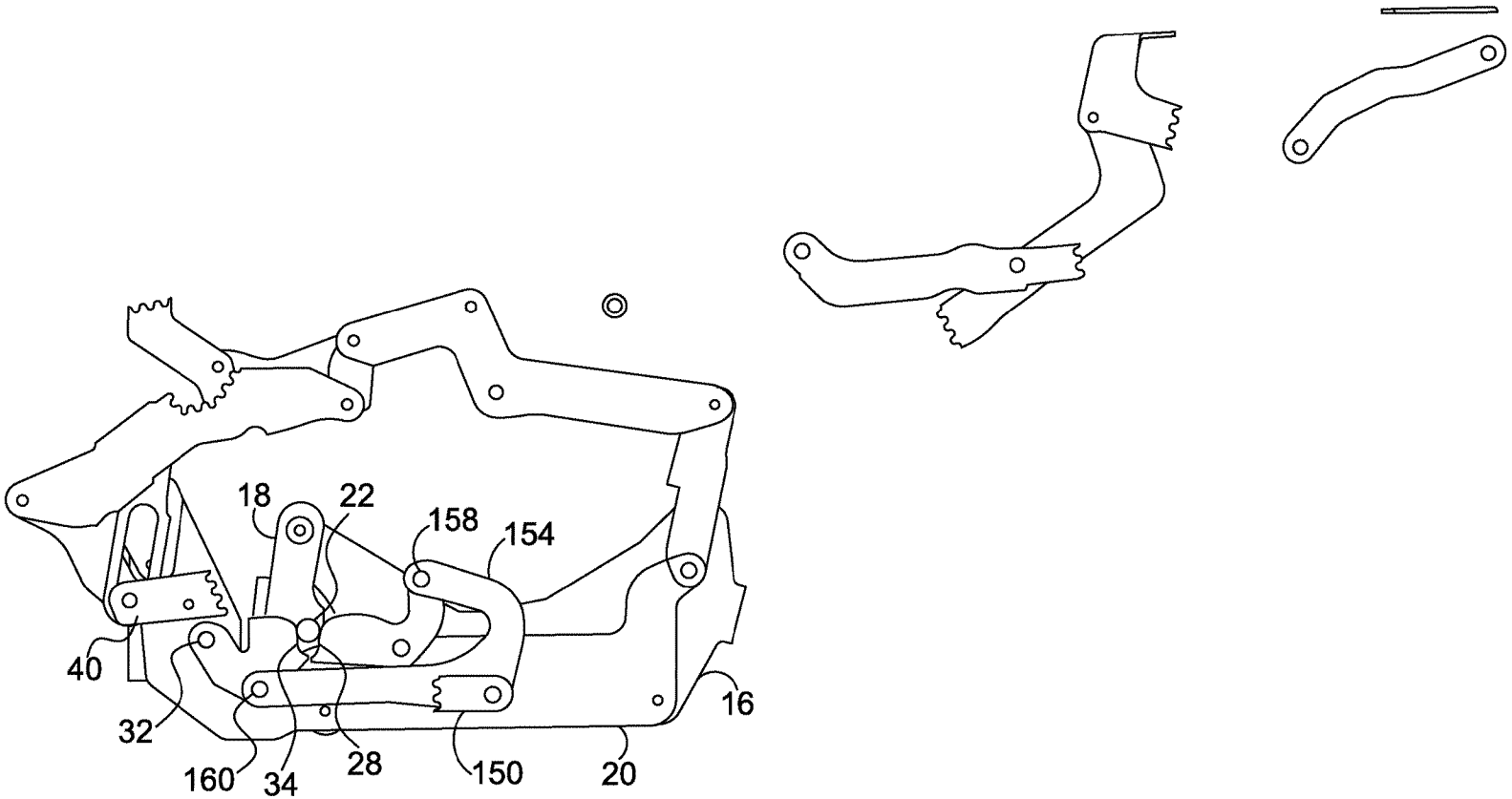
FIG. 14 is a view of FIG. 13 with certain components, or portions of components, removed for clarity to reveal other components.

As noted above, rotation of front blocker cam 24 and rear blocker cam 30, in concert with moving from the closed to the TV position, can be achieved in several ways. Another exemplary aspect is shown in FIGS. 11-14. In this aspect, the rotation is again driven by movement of the footrest drive link 40. A blocker control link 150 is pivotably coupled to footrest drive link 40 at pivot point 152. Blocker control link 150 extends forwardly and is pivotably coupled on its forward end to a blocker connector link 154 at pivot point 156. Blocker connector link 154 has an approximate J-shape and is pivotably coupled on one outer end to front blocker cam 24 at pivot point 158 and is pivotably coupled on the other outer end to rear blocker cam 30 at pivot point 160. Operationally, this aspect functions largely as described above. More specifically, as the glider-recliner moves from the closed position to the TV position, the footrest drive link 40 moves forwardly, moving the blocker control link 150 forwardly. This movement also moves the blocker connector link 154 forwardly and upwardly (compare FIG. 11 to FIG. 12). As the blocker connector link 154 moves it drives rotation of front blocker cam 24 about pivot point 26 and the rear blocker cam 30 about pivot point 32. Therefore, as the glider-recliner moves from the closed position to the TV position, the front blocker cam 24 and the rear blocker cam 30 are again rotated in opposite directions. In the TV position, cam surface 28 of front blocker cam 24, and cam surface 34 of rear blocker cam 30 hold the blocker pin 22 on the rear glide link 18, preventing any gliding movement. This held condition of blocker pin 22 remains as the glider recliner is moved to the fully-extend position, as shown in FIG. 13. When the glider-recliner is returned to the closed position, the footrest drive link 40 moves rearwardly, and through the connections of the blocker control link 150 and blocker connector link 154, the front blocker cam 24 and the rear blocker cam 30 are returned to the position shown in FIG. 11, once again allowing gliding movement.

Figure 19:
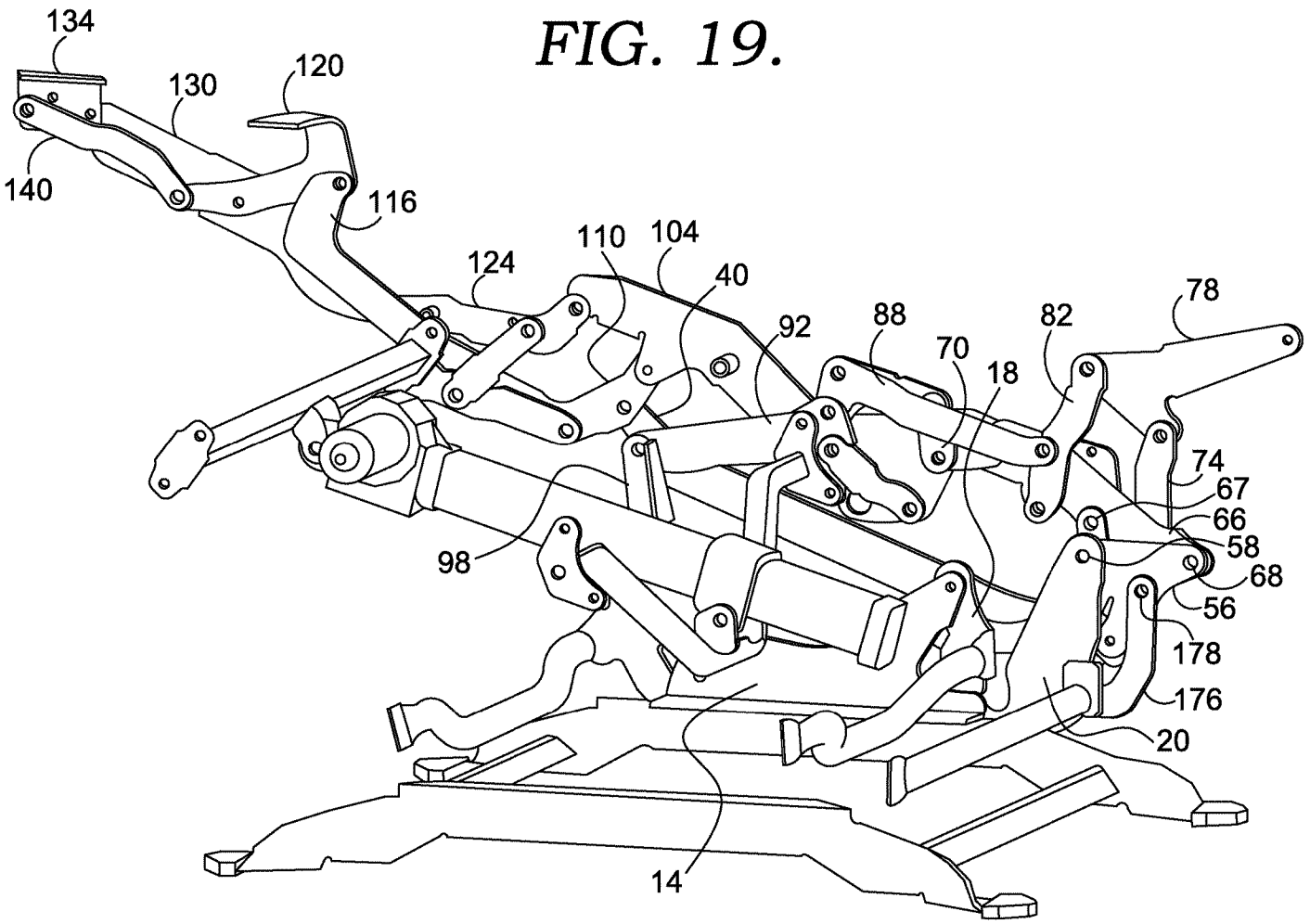
FIG. 19 is a perspective view of the mechanism of claim 17, shown with one side removed for clarity.

Another exemplary aspect for implementing rotation of the front and rear blocker cams, in concert with moving from the closed to the TV position, is shown in FIGS. 15-19. In this aspect, the rotation of a front blocker cam 24' is again driven by movement of the footrest drive link 40. More specifically, a front blocker control link 170 is pivotably coupled to footrest drive link 40 at pivot point 172. Front blocker control link 170 extends forwardly and is pivotably coupled on its forward end directly to the front blocker cam 24' at pivot point 174. A rear blocker control link 176 is pivotably coupled on one end to rear pivot link 56 and pivot point 178, and is pivotably coupled on the other end to a rear blocker cam 30' at pivot point 180. In this aspect, front blocker cam 24' and rear blocker cam 30' have slightly different overall shapes so as to properly connect with the front blocker control link 170 and the rear blocker control link 176, respectively. Operationally, this aspect functions as the other embodiments described above, in that front blocker cam 24' and rear blocker cam 30' are caused to rotate in opposite directions as the glider-recliner moves from the closed position to the TV position. In this aspect however, as the footrest drive link 40 moves forwardly, it drives the front blocker control link 170 forwardly, to drive rotation of front blocker cam 24' about pivot point 26. As the glider-recliner moves from the closed position to the TV position, the rear pivot link 56 rotates, driving rotation of rear blocker cam 30' about pivot point 32. Therefore, as the glider-recliner moves from the closed position to the TV position, the front blocker cam 24' and the rear blocker cam 30' are again rotated in opposite directions. In the TV position, cam surface 28 of front blocker cam 24', and cam surface 34 of rear blocker cam 30' hold the blocker pin 22 on the rear glide link 18, preventing any gliding movement. This held condition of blocker pin 22 remains as the glider recliner is moved to the fully-extend position, as shown in FIG. 19. When the glider-recliner is returned to the closed position, the footrest drive link 40 moves rearwardly, and through the connections of the front blocker control link 170, the front blocker cam 24' is returned to the position shown in FIG. 15. As the glider-recliner is returned to the closed position, the rear pivot link 56 rotates, and through the connection of the rear blocker control link 176, the rear blocker cam 30' also is returned to the position shown in FIG. 15, once again allowing gliding movement.

The blocker linkage described above can be implemented on a motorized glider-recliner or a manual glider-recliner, depending on the desired end use. As would be understood by those of skill in the art, in a motorized version, such as shown in FIG. 19, a base and motor are coupled to the glider-recliner linkage. An exemplary base and motor structure is shown and described in United States Provisional Patent Application No. 62/368,283, filed on Jul. 29, 2016, which is hereby incorporated by reference.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A blocker linkage for use in selectively locking a glider-recliner, the glider-recliner operable to move between closed, TV and full-recline positions, the blocker linkage comprising:

a glide bracket having a forward end and a rearward end;

a front glide link having a top end and a bottom end, the top end being pivotably coupled to the forward end of the glide bracket;

a rear glide link having a top end and a bottom end, the top end being pivotably coupled to the rearward end of the glide bracket;

a blocker pin coupled to the rear glide link;

a carrier link pivotably coupled to the bottom of the front glide link and pivotably coupled to the bottom of the rear glide link;

a rear blocker cam pivotably coupled to the carrier link; and a front blocker cam pivotably coupled to the carrier link, wherein the rear blocker cam and the front blocker cam are operably coupled to cooperatively engage the blocker pin and prevent movement of the rear glide link when the glider-recliner is moved to the TV and full-recline positions.

2. The blocker linkage of claim 1, further comprising:

a footrest drive link that moves as the glider-recliner moves between closed, TV and full-recline positions;

a blocker control link pivotably coupled to the footrest drive link and pivotably coupled to the front blocker cam, wherein movement from the closed position to the TV position moves the footrest drive link, which moves the blocker control link to effect rotation of the front blocker cam from a position disengaged from the blocker pin when the glider-recliner is in the closed position to a positioned engaged with the blocker pin when the glider-recliner is in the TV position.

3. The blocker linkage of claim 2, further comprising:

a blocker connector link pivotably coupled on one end to the blocker control link and pivotably coupled on the other end to the rear blocker cam, such that movement of the blocker control link effects a corresponding movement of the blocker connector link to effect rotation of the rear blocker cam from a position disengaged from the blocker pin when the glider-recliner is in the closed position to a positioned engaged with the blocker pin when the glider-recliner is in the TV position.

4. The blocker linkage of claim 3, wherein the coupling of the blocker control link and the front blocker cam results in the front blocker cam rotating in a first direction as the glider-recliner moves from the closed position to the TV position, and wherein the coupling of the blocker connector link and the rear blocker cam results in the rear blocker cam rotating in a second direction as the glider-recliner moves from the closed position to the TV position.

5. The blocker linkage of claim 1, wherein the front blocker cam has a cam surface configured to engage the blocker pin, and wherein the rear blocker cam has a cam surface configured to engage the blocker pin.

6. The blocker linkage of claim 1, further comprising:

a footrest drive link that moves as the glider-recliner moves between closed, TV and full-recline positions;

a blocker control link having a first end and a second end, the first end pivotably coupled the footrest drive link; and a blocker connector link pivotably coupled to the blocker control link, and pivotably coupled to the front blocker cam and to the rear blocker cam, such that movement of the blocker control link effects a corresponding movement of the blocker connector link to effect rotation of the front blocker cam and the rear blocker cam from positions disengaged from the blocker pin when the glider-recliner is in the closed position to positions engaged with the blocker pin when the glider-recliner is in the TV position.

7. The blocker control linkage of claim 6, wherein the coupling of the blocker control link, the blocker connector link and the front blocker cam and rear blocker cam results in the front blocker cam rotating in a first direction as the glider-recliner moves from the closed position to the TV position, and the rear blocker cam rotating in a second direction as the glider-recliner moves from the closed position to the TV position.

8. The blocker control linkage of claim 1, further comprising:

a footrest drive link that moves as the glider-recliner moves between closed, TV and full-recline positions;

a rear pivot link pivotably coupled to the footrest drive link;

a front blocker control link pivotably coupled to the footrest drive link and pivotably coupled to the front blocker cam, the front blocker control link driven by the footrest drive link to effect rotation of the front blocker cam from a position disengaged from the blocker pin when the glider-recliner is in the closed position to a position engaged with the blocker pin when the glider-recliner is in the TV position; and a rear blocker control link pivotably coupled to the rear pivot link and pivotably coupled to the rear blocker cam, the rear blocker control link driven by the rear pivot link to effect rotation of the rear blocker cam from a position disengaged from the blocker pin when the glider-recliner is in the closed position to a position engaged with the blocker pin when the glider-recliner is in the TV position.

9. A blocker linkage for use in selectively locking a glider-recliner, the glider-recliner operable to move between closed, TV and full-recline positions, the blocker linkage comprising:

a glide bracket having a forward end and a rearward end;

a front glide link having a top end and a bottom end, the top end being pivotably coupled to the forward end of the glide bracket;

a rear glide link having a top end and a bottom end, the top end being pivotably coupled to the rearward end of the glide bracket, the rear glide link further having a blocker pin extending outwardly and located between the top end and the bottom end;

a carrier link pivotably coupled to the bottom of the front glide link and pivotably coupled to the bottom of the rear glide link;

a rear blocker cam pivotably coupled to the carrier link;

a front blocker cam pivotably coupled to the carrier link; and a cam linkage operable to rotate the rear blocker cam in a first direction, and the front blocker cam in a second direction as the glider-recliner is moved from the closed to the TV position, such that the rear blocker cam and the front blocker cam cooperatively engage the blocker pin and prevent movement of the rear glide link.

10. The blocker linkage of claim 9, wherein the cam linkage comprises:

a footrest drive link that moves as the glider-recliner moves between closed, TV and full-recline positions;

a blocker control link pivotably coupled to the footrest drive link and pivotably coupled to the front blocker cam; and a blocker connector link pivotably coupled on one end to the blocker control link and pivotably coupled on the other end to the rear blocker cam.

11. The blocker linkage of claim 9, wherein the front blocker cam has a cam surface configured to engage the blocker pin, and wherein the rear blocker cam has a cam surface configured to engage the blocker pin.

12. The blocker linkage of claim 9, further comprising:

a footrest drive link that moves as the glider-recliner moves between closed, TV and full-recline positions;

a blocker control link having a first end and a second end, the first end pivotably coupled the footrest drive link; and a blocker connector link pivotably coupled to the blocker control link, and pivotably coupled to the front blocker cam and to the rear blocker cam, such that movement of the blocker control link effects a corresponding movement of the blocker connector link to effect rotation of the front blocker cam and the rear blocker cam from positions disengaged from the blocker pin when the glider-recliner is in the closed position to a positions engaged with the blocker pin when the glider-recliner is in the TV position.

13. The blocker linkage of claim 9, further comprising:

a footrest drive link that moves as the glider-recliner moves between closed, TV and full-recline positions;

a rear pivot link pivotably coupled to the footrest drive link;

a front blocker control link pivotably coupled to the footrest drive link and pivotably coupled to the front blocker cam, the front blocker control link driven by the footrest drive link to effect rotation of the front blocker cam from a position disengaged from the blocker pin when the glider-recliner is in the closed position to a position engaged with the blocker pin when the glider-recliner is in the TV position; and a rear blocker control link pivotably coupled to the rear pivot link and pivotably coupled to the rear blocker cam, the rear blocker control link driven by the rear pivot link to effect rotation of the rear blocker cam from a position disengaged from the blocker pin when the glider-recliner is in the closed position to a position engaged with the blocker pin when the glider-recliner is in the TV position.

14. A glider-recliner linkage operable to move between closed, TV and full-recline positions having a blocker linkage for use in selectively preventing gliding movement when the glider-recliner moves from the closed position to the TV and full-recline positions, the glider-recliner linkage comprising:

a glide bracket having a forward end and a rearward end;

a front glide link having a top end and a bottom end, the top end being pivotably coupled to the forward end of the glide bracket;

a rear glide link having a top end and a bottom end, the top end being pivotably coupled to the rearward end of the glide bracket, the rear glide link further having a blocker pin extending outwardly and located between the top end and the bottom end;

a carrier link pivotably coupled to the bottom of the front glide link and pivotably coupled to the bottom of the rear glide link;

a rear blocker cam pivotably coupled to the carrier link;

a front blocker cam pivotably coupled to the carrier link;

a recline linkage operable to move the glider-recliner to and from the closed, TV and full-recline positions; and a cam linkage coupled to the recline linkage operable to rotate the rear blocker cam in a first direction, and the front blocker cam in a second direction as the recline linkage moves the glider-recliner from the closed to the TV position, such that the rear blocker cam and the front blocker cam cooperatively engage the blocker pin and prevent movement of the rear glide link.

15. The glide-recliner linkage of claim 14, wherein the cam linkage comprises:

a footrest drive link that moves as the glider-recliner moves between closed, TV and full-recline positions;

a rear pivot link pivotably coupled to the footrest drive link;

a front blocker control link pivotably coupled to the footrest drive link and pivotably coupled to the front blocker cam, the front blocker control link driven by the footrest drive link to effect rotation of the front blocker cam from a position disengaged from the blocker pin when the glider-recliner is in the closed position to a position engaged with the blocker pin when the glider-recliner is in the TV position; and a rear blocker control link pivotably coupled to the rear pivot link and pivotably coupled to the rear blocker cam, the rear blocker control link driven by the rear pivot link to effect rotation of the rear blocker cam from a position disengaged from the blocker pin when the glider-recliner is in the closed position to a position engaged with the blocker pin when the glider-recliner is in the TV position.

16. The blocker linkage of claim 15, wherein the front blocker cam has a cam surface configured to engage the blocker pin, and wherein the rear blocker cam has a cam surface configured to engage the blocker pin.

* * * * *